United States Patent [19]

Irzinski

[11] 4,446,463

[45] May 1, 1984

[54] COAXIAL WAVEGUIDE COMMUTATION FEED NETWORK FOR USE WITH A SCANNING CIRCULAR PHASED ARRAY ANTENNA

[75] Inventor: Edward P. Irzinski, Gaithersburg, Md.

[73] Assignee: The United States of America as represented by the Secretary of the Navy, Washington, D.C.

[21] Appl. No.: 351,831

[22] Filed: Feb. 24, 1982

[51] Int. Cl.[3] ..... H01Q 3/22; H01Q 3/24; H01Q 3/26; H01P 5/12

[52] U.S. Cl. ..... 343/371; 333/34; 333/226; 333/233; 333/136

[58] Field of Search ..... 333/21 R, 124, 125, 333/127, 136, 34, 33, 245, 248; 343/854, 373, 372, 371, 427

[56] References Cited

U.S. PATENT DOCUMENTS

| | | | |
|---|---|---|---|
| 3,290,682 | 12/1966 | Ajioka . | |
| 3,440,570 | 4/1969 | Kasper | 333/116 |
| 3,641,578 | 2/1972 | Sparos et al. | 343/373 X |
| 3,713,167 | 1/1973 | David | 343/373 X |
| 3,728,648 | 4/1973 | Lerner . | |
| 4,005,379 | 1/1977 | Lerner . | |
| 4,096,482 | 6/1978 | Walters | 343/373 X |
| 4,103,262 | 7/1978 | Woodward | 333/136 |

OTHER PUBLICATIONS

Young, Victor J. and Jones, Meridith W., *Pictorial Microwave Dictionary* A Rider Publication, 1956, pp. 29 and 95.

*Primary Examiner*—Paul L. Gensler
*Assistant Examiner*—Benny Lee
*Attorney, Agent, or Firm*—Robert F. Beers; Kenneth E. Walden; John G. Wynn

[57] ABSTRACT

A dominant TEM mode and a pair of spatially orthogonal $TE_{11}$ modes suitably excited at the input ports of a coaxial waveguide commutator portion of a coaxial waveguide commutation feed network are employed to generate a commutatable low-sidelobe amplitude distribution at symmetrically disposed peripheral output ports of the coaxial waveguide commutator. The resulting low-sidelobe amplitude distribution can be used to feed radiating elements of an associated circular phased array antenna. The coaxial waveguide commutator is configured, inter alia, with a linearly tapered inner conductor surrounded by a uniform tube outer conductor to achieve a smoother TEM-dominant mode characteristic impedance transition from the input port plane to the output port plane thereof. Employment of this feed geometry, in conjunction with balanced four-port feeding of the coaxial waveguide commutator which inhibits the higher order TE modes, increases the bandwidth capability while maintaining low insertion loss.

9 Claims, 2 Drawing Figures

COAXIAL WAVEGUIDE COMMUTATION FEED NETWORK FOR USE WITH A SCANNING CIRCULAR PHASED ARRAY ANTENNA

BACKGROUND OF THE INVENTION

1. Field of the Invention

The present invention relates, in general, to microwave amplitude commutation feed devices, but more specifically it relates to a coaxial waveguide amplitude commutation network configured to operate compatibly with a scanning circular array antenna.

2. Description of the Prior Art

RF feed network implementation has been recognized as a critical problem area in scanning circular array antenna systems. A fundamental requirement of the rf feed network is the capability to commutate a desirable low-sidelobe amplitude distribution about the periphery of the circular array antenna in such a manner that a given number of radiating elements in a 180° or smaller sector is excited at any instant of time. The rf feed implementation trade-off is usually one of physical complexity with the accompanying insertion-loss and tolerance control problems versus the ultimate desire of complete commutation capability of the ideal complex amplitude distribution, i.e., the desirable amplitude distribution magnitude and the requisite phase characteristics for plane-wave generation from a circular sector boundary. The network implementation problem is one of practical rather than theoretical realizability and a number of rf feed networks have been developed to cope with the circular array antenna geometry. Among these have been the R-2R lens feed [1], the Butler Matrix feed [2], the transfer switch matrix feed [3], and the waveguide commutator feed [4]. Various other feasible circular array feed configurations have also appeared in the prior art but they can essentially be categorized as one or a combination of the basic four feed types aforementioned.

The referenced feed networks all possess the desired capability of performing the amplitude commutation function, but each configuration is associated with one or more undesirable physical or performance attributes which most frequently reside in the areas of design complexity, rf output amplitude and phase tolerance control, insertion loss, or bandwidth limitations. The coaxial waveguide commutation feed network, according to the present invention, is characterized by simplicity of configuration with a resultant significant overall improvement in the critical cited performance areas. A key element of the coaxial waveguide commutation feed network is a coaxial waveguide commutator similar in performance capability to the radial waveguide design developed previously [4] but without the bandwidth limitations inherent in this nonuniform transmission-line device [5]. Some unique features of the coaxial waveguide commutation feed network are a simple coaxial input probe excitation implementation technique and the capability of an rf bandwidth in excess of 30-percent with respect to the mid-band frequency at which the coaxial waveguide commutator is tuned. The tuning devices of the present invention can be employed to tune to different mid-band frequencies while maintaining the 30-percent rf bandwidth operation. A dominant TEM mode and a pair of orthogonal $TE_{11}$ modes excited within the coaxial waveguide commutator are employed to generate a commutatable low-side-lobe amplitude distribution about the periphery at its output ports.

An exemplary sample of a network for supplying rf power to a plurality of radiators in a phased array according to a desired distribution pattern is disclosed in U.S. Pat. No. 4,005,379 to Lerner entitled "R.F. Distribution Network for Phased Antenna Array," issued on Jan. 25, 1977 from application Ser. No. 628,469, filed Nov. 4, 1975. In Lerner, a TEM mode and a pair of selectively phase shifted $TE_{11}$ modes are derived and applied to input ports of a cavity resonator to produce the desired rf power distribution at a plurality of output ports. The cavity resonator is a cylindrical member in which the output ports are arranged circumferentially about the periphery and axially spaced from the $TE_{11}$ mode input ports.

Lerner uses a single probe to excite the dominant TEM mode in the coaxial section of the cavity resonator, and a pair of probes to excite a single $TE_{11}$ mode, plus another pair of probes to excite an orthogonal $TE_{11}$ mode. Using only a single probe pair to excite a $TE_{11}$ mode limits the bandwidth capability compared to four-probe excitation in a coaxial waveguide. Consequently, there is a need in the prior art to configure a coaxial waveguide commutation network to including four-port feeding to inhibit the higher order TE modes thereby increasing the bandwidth capability.

Lerner also uses a 3db coupler, a pair of phase shifters, and a pair of baluns to achieve the excitation of the pair of $TE_{11}$ modes. This arrangement appears to be inherently more difficult to align and to control so as to produce the selective phasing required between the pair of $TE_{11}$ modes and the TEM mode so that the low-sidelobe amplitude distribution can be rotated about the output ports. Hence, there is a need in the prior art to configure networks of the kind discussed to have broadband capability while maintaining simplicity in configuration and alignment, and reliability in performance.

Additionally, Lerner does not incorporate any special impedance matching techniques to provide a smooth impedance transition for the dominant TEM mode from the input ports to the output ports of the commutator. Thus, there is a need in the prior art to provide a smooth impedance transition to further enhance bandwidth.

The prior art, as indicated hereinabove, include some progress in implementing feed networks to cope with the special problems inherent in the circular array antenna geometry. However, insofar as can be determined, no prior art network or method incorporates all of the features and advantages of the present invention.

OBJECTS OF THE INVENTION

Accordingly, an important object of the present invention is to configure, in an improved manner, a broadband version of a coaxial waveguide commutation feed network.

Another important object of the present invention is to be able to interface the improved coaxial waveguide commutation feed network to a scanning circular phased array antenna while maintaining the broadband operation.

Yet another important object of the present invention is to increase the bandwidth of the coaxial waveguide commutation feed network while maintaining its inherent low insertion loss.

A further important object of the present invention is to configure the improved coaxial waveguide commutator portion of the present invention to include a tapered inner conductor to produce a smooth impedance transition for the dominant TEM mode thereby enhancing bandwidth.

Still a further object of the present invention is to configure the coaxial waveguide commutation feed network to include balanced four-port feeding to inhibit the higher order TE modes thereby increasing the bandwidth capability.

Yet a further important object of the present invention is to carry-out the foregoing objects while maintaining simplicity in configuration and alignment, and reliability in performance.

SUMMARY OF THE INVENTION

The coaxial waveguide commutation feed network, according to the present invention, by which the foregoing and other objects, features and advantages are accomplished is characterized, inter alia, by a $K_{db}$ coupler, a variable power divider and a monopulse bridge comparator in combination with a coaxial waveguide commutator.

An rf input is divided into two outputs via the $K_{db}$ coupler. One of these outputs is the input to the sum port of the monopulse bridge comparator. The four outputs of the monopulse bridge comparator are connected to four symmetrically disposed input ports (probes) of the coaxial waveguide commutator. Thus, the sum port input to the monopulse bridge comparator excites the TEM mode in the coaxial waveguide commutator. The second output from the $K_{db}$ coupler is the input to the variable power divider. The variable power divider outputs are the inputs to the difference ports of the monopulse bridge comparator. Consequently, the variable power divider excites a pair of spatially orthogonal $TE_{11}$ modes in the coaxial waveguide commutator.

BRIEF DESCRIPTION OF THE DRAWINGS

The foregoing and other objects, novel features and advantages of the present invention will be more apparent from the following more particular description of the preferred embodiment as illustrated in the accompanying drawings,in which.

DESCRIPTION OF THE PREFERRED EMBODIMENT

The following is a brief description of the coaxial waveguide commutation feed network, according to the present invention, for use with a scanning circular phased array antenna.

Figure 1:
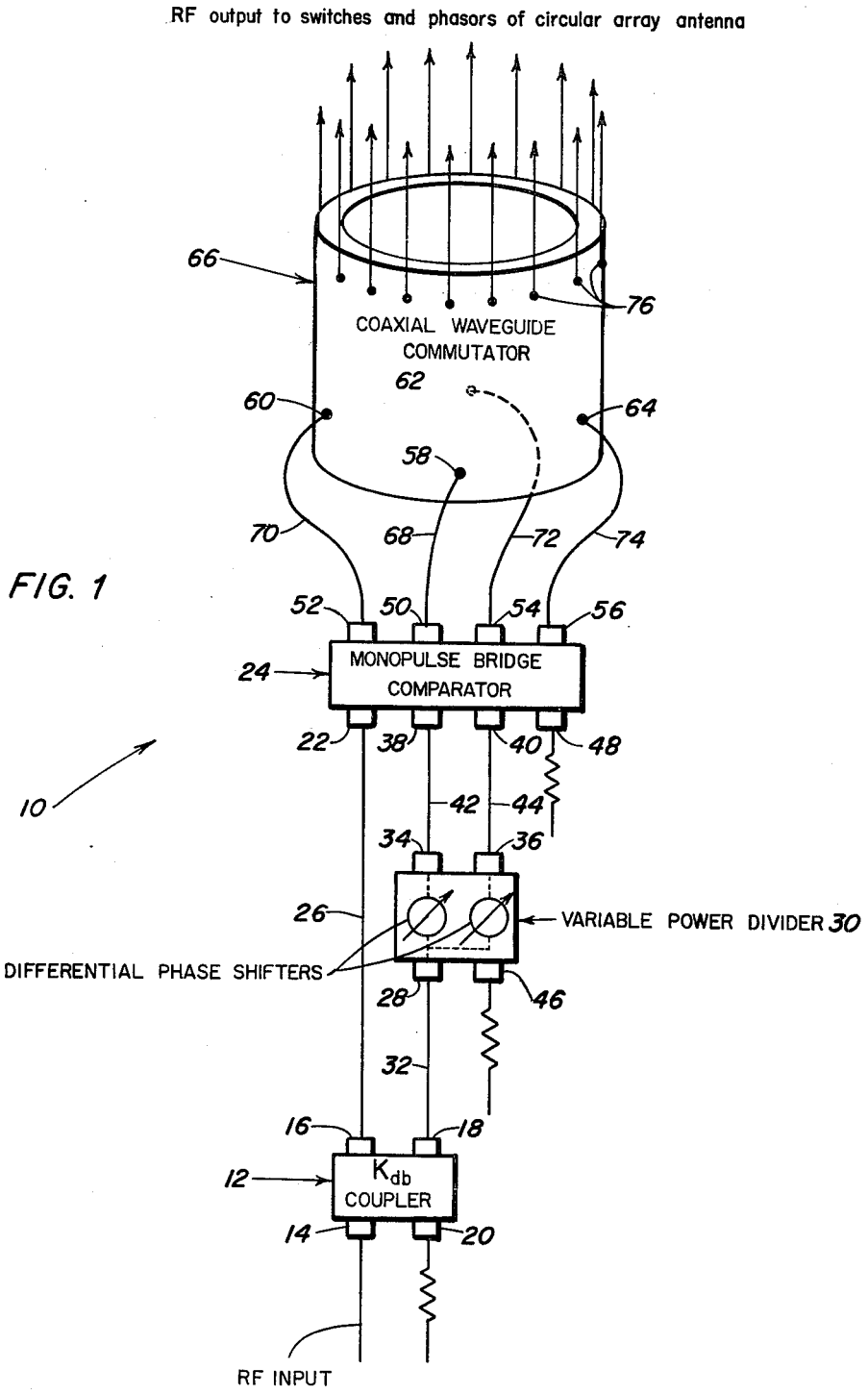
FIG. 1 is a pictorial and schematic representation of the coaxial waveguide commutation network, including a $K_{db}$ coupler, a variable power divider, a monopulse bridge comparator, and a coaxial waveguide commutator, according to the present invention.

Referring then to FIG. 1, coaxial waveguide commutation feed network 10 comprises a $K_{db}$ coupler 12 having an input port 14, a pair of output ports 16 and 18, and a suitably terminated isolated port 20. Output port 16 of $K_{db}$ coupler 12 is coupled to an input port (sum port) 22 of a monopulse bridge comparator 24, via a suitable transmission line 26. The other output port 18 of $K_{db}$ coupler 12 is operatively coupled to the input port 28 of a variable power divider 30, via a suitable transmission line 32. A pair of output ports 34 and 36 of variable power divider 30 are operatively connected to input ports (difference ports) 38 and 40, respectively, of monopulse bridge comparator 24, via suitable transmission lines 42 and 44, respectively. Variable power divider 30 further includes a suitably terminated difference port 46, and monopulse bridge comparator 24 further includes a suitably terminated isolated port 48. Four output ports 50, 52, 54, and 56 of monopulse bridge comparator 24 are coupled to four corresponding symmetrically disposed input ports 58, 60, 62 and 64, respectively, of a coaxial waveguide commutator 66, via suitable transmission lines 68, 70, 72 and 74, respectively. Coaxial waveguide commutator 66 is terminated in a plurality of symmetrically disposed (with respect to input ports 58, 60, 62 and 64), output ports 76.

Figure 2:
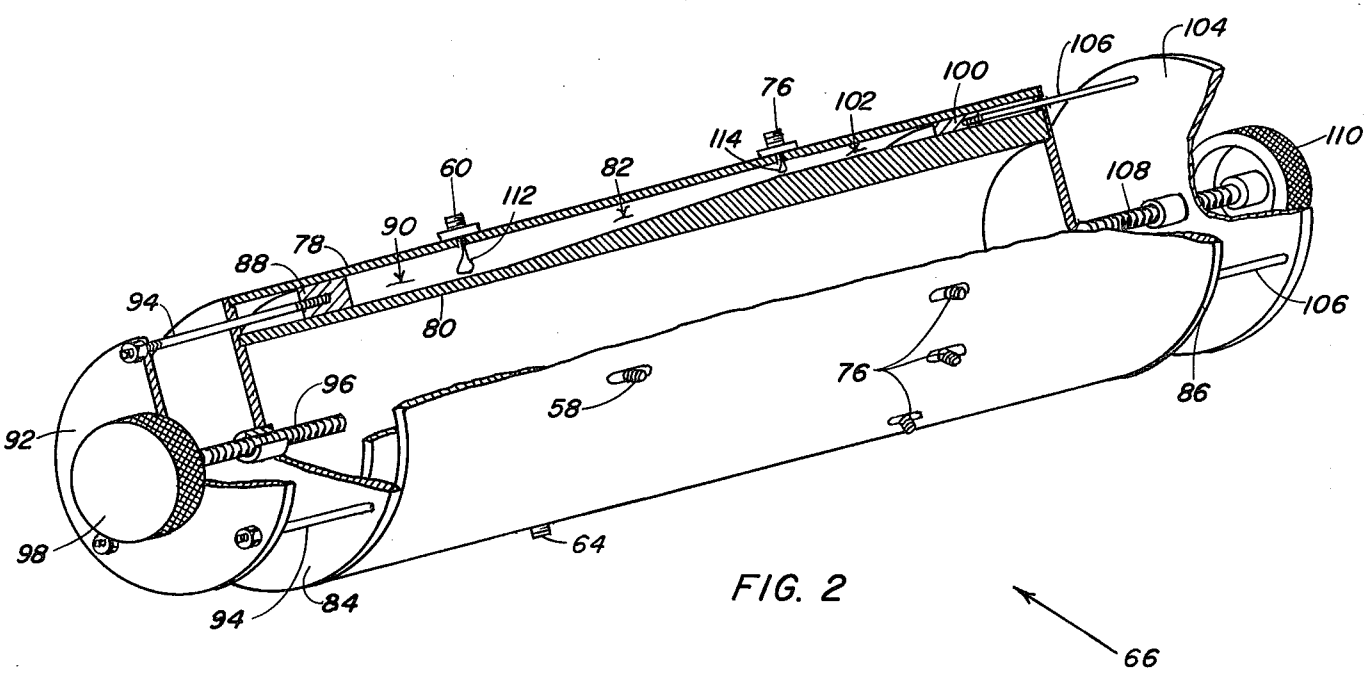
FIG. 2 is a perspective view of the coaxial waveguide commutator of FIG. 1 in partial section and partially cut-away to show in more detail the pertinent parts and their interconnects, according to the present invention.

Referring now to FIG. 2, coaxial waveguide commutator 66 further comprises a uniform tube outer conductor 78, a linearly tapered inner conductor 80 coaxially disposed within uniform tube outer conductor 78, defining therebetween a central region of linear taper 82. The aforementioned conductors are affixed at their input ends to an input endplate 84 and at their output ends to an output endplate 86. For purposes of tuning at the input port plane defined by input ports 58, 60, 62 and 64, an input annular shorting ring 88 is disposed contiguously between uniform tube outer conductor 78 and linearly tapered inner conductor 80 in a non-tapered input region 90 defined thereby. Input annular shorting ring 88 is slidable and acts to short out a portion of coaxial waveguide commutator 66 at its input end. Input annular shorting ring 88 is connected to a movable input mounting plate 92 via a plurality of operatively connected and symmetrically disposed connecting rods 94. An input tuning adjustment screw 96 is threadedly journaled into both input endplate 84 and movable input mounting plate 92. Input tuning adjustment screw 96 is also fixedly connected to an input tuning knob 98 which, in turn, is fixedly and rotatably attached to movable input mounting plate 92. Consequently, when input tuning knob 98 is turned clockwise, movable input mounting plate 92 moves inward thereby moving input annular shorting ring 88 inward. The converse is true when input tuning knob 98 is turned counter-clockwise. An optimum impedance match occurs at the input port plane when input annular shorting ring 88 is approximately one-quarter of a TEM mode wavelength at mid-band frequency from the aforementioned input port plane.

Still referring to FIG. 2, for purposes of tuning at the output port plane defined by plurality of output ports 76, an output annular shorting ring 100 is disposed contiguously between uniform tube outer conductor 78 and linearly tapered inner conductor 80 in a non-tapered output region 102. Output annular shorting ring 100 is slidable and acts to short out a portion of coaxial waveguide commutator 66 at its output end. Output annular shorting ring 100 is connected to a movable output mounting plate 104 via a plurality of operatively connected and symmetrically disposed output connecting rods 106. An output tuning adjustment screw 108 is threadedly journaled into both output endplate 86 and movable output mounting plate 104. Output tuning adjustment screw 108 is also fixedly connected to an output tuning knob 110 which, in turn, is fixedly and rotatably attached to movable output mounting plate 104. Thus, when output tuning knob 110 is turned clockwise, movable output mounting plate 104 moves inward thereby moving output annular shorting ring 100 inward. The converse is true when output tuning knob 110 is turned counter-clockwise. Here also, an optimum impedance match occurs at the output port plane when output annular shorting ring 100 is approximately one-quarter of a TEM mode wavelength at mid-band frequency from the aforementioned output port plane.

It should be noted that input probes 112 and output probes 114 of input ports 58, 60, 62 and 64, and plurality of output ports 76, respectively, are contoured, as shown, to facilitate impedance matching.

STATEMENT OF THE OPERATION

Details of the operation, according to the present invention, are explained in conjunction with FIGS. 1 and 2 viewed concurrently. The rf input at sum port 14 is divided into a TEM path signal and a $TE_{11}$ path signal at output ports 16 and 18, respectively, of $K_{db}$ coupler 12. The TEM path signal at output port 16 is the input to sum port 22 of monopulse bridge comparator 24. The four output ports 50, 52, 54 and 56 of monopulse bridge comparator 24 are connected to four symmetrically disposed input ports 58, 60, 62, and 64, respectively, of coaxial waveguide commutator 66. The TEM path signal at sum port 22 of monopulse bridge comparator 24 excites the TEM mode in coaxial waveguide commutator 66 because the signals on output ports 50,52,54 and 56 are split into equal parts having the same amplitudes and phases. The $TE_{11}$ path signal at output port 18 of $K_{db}$ coupler 12 is the input signal to variable power divider 30. Variable power divider 30, for purposes of the present invention, can be equivalent to the device of reference [6] which employs a magic tee, a 90° hybrid, and a pair of differential phase shifters for controlling the relative magnitudes of the rf outputs. A special and desirable feature of variable power divider 30 is that output ports 34 and 36 phase track each other. The output signals at output ports 34 and 36 of variable power divider 30, which are variable amplitude $TE_{11}$ path signals, are the inputs to difference ports 38 and 40, respectively, of monopulse bridge comparator 24. The $TE_{11}$ path signal at difference port 38 of monopulse bridge comparator 24 excites a $TE_{11}$ mode in coaxial waveguide commutator 66 because, inter alia, the signals on the output ports 50,52,54 and 56 are split into equal parts having the same amplitudes. The pair of signals at output ports 50 and 52 have equal phases and the pair of signals at output ports 54 and 56 have equal phases. But the phase difference between the pair of signals is 180°. Conversely, the other $TE_{11}$ path signal at difference port 40 excites another $TE_{11}$ mode in coaxial waveguide commutator 66 because although the signals of the aforementioned output ports are split into equal parts having the same amplitudes and the pair of signals at output ports 50 and 56 have the same phases and the pair of signals at output ports 52 and 54 have the same phases, the phase difference between the pair of signals is 180°. Consequently, variable power divider 30 excites a pair of spatially orthogonal $TE_{11}$ modes in coaxial waveguide commutator 66.

For purposes of the present invention, coaxial waveguide commutator 66 is a traveling wave device which is terminated in a plurality of output ports 76 (for example sixteen ports) symmetrically disposed with respect to input ports 58, 60, 62 and 64. In the output port plane defined by output ports 76 of coaxial waveguide commutator 66, a radial electric field intensity of the form $$V(\phi) = \left(\frac{1+A}{2}\right) + \left(\frac{1-A}{2}\right) \sin\alpha \sin\phi + \left(\frac{1-A}{2}\right) \cos\alpha \cos\phi \tag{1}$$

will exist by a superposition of the functionally orthogonal TEM and $TE_{11}$ mode pairs. The first term on the right of (1) is the constant contribution from the TEM mode. The remaining two terms are characterized by the sin $\phi$, cos $\phi$, angular variation of the spatially orthogonal $TE_{11}$ modes with the magnitude proportionality factors sin $\alpha$, cos $\alpha$ arising from the differential phase shift settings $$\left(\alpha; \frac{\pi}{2} - \alpha\right)$$

of variable power divider 30. Equation (1) can be rewritten in the more recognizable consine-squared-on-a-pedestal form as $$V(\phi) = A + (1-A)\cos^2\tfrac{1}{2}(\phi - \alpha) \tag{2}$$

where the pedestal magnitude A is related to the coupling coefficient of $K_{db}$ coupler 12 as $$K_{db} = 10 \log\left(1 + 2\left(\frac{1+A}{1-A}\right)^2\right). \tag{3}$$

An inspection of (2) reveals that a low-sidelobe amplitude distribution proportional to $V(\phi)$ may be continuously commutated about the output periphery in the output port plane by a continuous variation of $\alpha$. Since a primary function of coaxial waveguide commutator 66 is to feed a circular array antenna, a variation of $\alpha$ in a digital manner will provide the necessary coarse commutation. The rf outputs of coaxial waveguide commutator 66 can be interfaced with an rf switch and phase shifter network as indicated (but not shown) in FIG. 1 prior to final termination at radiating element inputs of a circular array antenna (not shown). The rf phase shifters are employed for the dual functions of plane wave collimation of the cylindrical wavefront and a fine beam steering capability between the coarse discrete beam positions provided by the present invention. A monopulse tracking capability may be added to coaxial waveguide commutation feed network 10 by employing isolated difference port 46 of variable power divider 30.

A L-band model of a coaxial waveguide commutation feed network 10 including a coaxial waveguide commutator 66, according to the present invention, was designed, fabricated and tested verifying the disclosed circular array feed technique. The results of the test program, including coaxial waveguide commutator 66 measurements, array antenna pattern performance predictions and specific design criteria, are disclosed in [7].

While the present invention has been particularly described with reference to the preferred embodiment thereof, it will be understood by those skilled in the art that various changes in form and detail can be made therein without departing from the spirit and scope thereof.

REFERENCES

[1] J. E. Boyns, et. al., "A Lens Feed for a Ring Array", IEEE Trans. on Ant. and Prop., Vol. AP-16, No. 2 pp. 264–267, Mar. 1968.

[2] B. Sheleg, "A Matrix-Fed Circular Array for Continuous Scanning", Proc. of IEEE, Vol. 56, pp. 2016–2027, Nov. 1968.

[3] R. S. Giannini, "An Electronically Scanned Cylindrical Array Based on a Switching and Phasing Technique", IEEE Int. Symp. Ant. and Prop. Digest, pp. 199–207, Dec. 1969.

[4] B. F. Bogner, "Circularly Symmetric RF Commutator for Cylindrical Phase Arrays", IEEE Trans. on Ant. and Prop., Vol. AP-22, No. 1, pp. 78–81, Jan. 1974.

[5] N. Marcuvitz, "Waveguide Handbook", MIT Radiation Laboratory Series, Vol. 10 McGraw Hill Book Co., 1951.

[6] A. R. Dion, L. J. Ricardi, "A Variable Coverage Satellite Antenna System", IEEE Proceedings, Vol. 59, No. 2, Feb. 1971, pp. 252–262.

[7] E. P. Irzinski, "A Coaxial Waveguide Commutator Feed for a Scanning Circular Phased Array Antenna", IEEE Trans. on Microwave Theory and Techniques, Vol. MTT-29, No. 3, pp. 266–270, Mar. 1981.

What is claimed is:

1. A coaxial waveguide commutation feed network for generating a commutatable low-sidelobe amplitude distribution in response to an rf input signal suitable for feeding radiating elements of an associated circular phased array antenna comprising:

a $K_{db}$ coupler for dividing the rf input signal into a TEM path signal and a $TE_{11}$ path signal;

a variable power divider incorporating a pair of differential phase shifters operatively connected to said $K_{db}$ coupler for dividing the $TE_{11}$ path signal into a first variable amplitude $TE_{11}$ path signal and a second variable amplitude $TE_{11}$ path signal, the amplitude of one of the signals being proportional to the sine $\alpha$ and the amplitude of the other signal being proportional to the cosine $\alpha$, $\alpha$ being derived from the phase settings of said pair of differential phase shifters;

a monopulse bridge comparator having four output ports for four-port balanced feeding, and operatively connected at its input to the TEM path signal of said $K_{db}$ coupler, and the first and second variable amplitude $TE_{11}$ path signals of said variable power divider; and a coaxial waveguide commutator operatively connected at its inputs to the four output ports of said monopulse bridge comparator such that the TEM path signal excites the TEM mode and the first and second variable amplitude $TE_{11}$ path signals excite a pair of spatially orthogonal $TE_{11}$ modes in said coaxial waveguide commutator and at its outputs.

2. The coaxial waveguide commutation feed network of claim 1 wherein said coaxial waveguide commutator further comprises:

a uniform tube outer conductor;

a linearly tapered inner conductor coaxially disposed within said uniform tube outer conductor defining therebetween a non-tapered input region, a central region of linear taper, and a non-tapered output region for achieving a smooth TEM-dominant mode characteristic impedance transition in the central region of linear taper:

support means for maintaining said uniform tube outer conductor and said linearly tapered inner conductor coaxially disposed;

a plurality of input ports operatively connected to the four output ports of said monopulse bridge comparator and symmetrically disposed about the periphery of said uniform tube outer conductor at the input and in the non-tapered input region of said waveguide commutator; and a plurality of output ports symmetrically disposed about the periphery of said uniform tube outer conductor at the output and in the non-tapered output region of said coaxial waveguide commutator.

3. The coaxial waveguide commutation network of claim 2 wherein said plurality of input ports include a corresponding plurality of input probes contoured to facilitate impedance matching thereat.

4. The coaxial waveguide commutation network of claim 3 wherein said plurality of output ports include a corresponding plurality of output probes contoured to facilitate impedance matching thereat.

5. The coaxial waveguide commutation feed network of claim 2 wherein said support means further comprises:

an input endplate for affixing said uniform tube outer conductor at the non-tapered input region to said linearly tapered inner conductor; and an output endplate for affixing said uniform tube outer conductor at the non-tapered output region to said linearly tapered inner conductor.

6. The coaxial waveguide commutation feed network of claim 5 further comprising:

input tuning means operatively connected to said uniform tube outer conductor and said linearly tapered inner conductor for tuning for an optimum impedance in the input port plane at said plurality of input ports; and output tuning means operatively connected to said uniform tube outer conductor and said linearly tapered inner conductor for tuning for an optimum impedance in the output port plane at said plurality of output ports.

7. The coaxial waveguide commutation feed network of claim 6 wherein said input tuning means further comprises:

an input annular shorting ring slidably and contiguously disposed between said uniform tube outer conductor and said linearly tapered inner conductor in the non-tapered input region for shorting out a portion of said coaxial waveguide commutator at its input;

a movable input mounting plate;

a plurality of connecting rods operatively connecting said input annular shorting ring to said movable input mounting plate;

an input tuning adjustment screw threadedly journaled into said movable input mounting plate and said input endplate; and an input tuning knob fixedly connected to said input tuning adjustment screw and fixedly and rotatably attached to said movable input mounting plate.

8. The coaxial waveguide commutation network of claim 6 wherein said output tuning means further comprises:

an output annular shorting ring slidably and contiguously disposed between said uniform tube outer conductor and said linearly tapered inner conductor in the non-tapered output region for shorting out a portion of said coaxial waveguide commutator at its output;

a movable output mounting plate;

a plurality of connecting rods operatively connecting said output annular shorting ring to said movable output mounting plate;

an output tuning adjustment screw threadedly journaled into said movable output mounting plate and said output endplate; and an output tuning knob fixedly connected to said output tuning adjustment screw and fixedly and rotatably attached to said movable output mounting plate.

9. A coaxial waveguide commutator for use with a scanning circular phased array antenna comprising:

a uniform tube outer conductor;

a linearly tapered inner conductor coaxially disposed within said uniform tube outer conductor defining therebetween a non-tapered input region, a central region of linear taper, and a non-tapered output region for achieving a smooth TEM-dominant mode characteristic impedance transition in the central region of linear taper;

support means for maintaining said uniform tube outer conductor and said linearly tapered inner conductor coaxially disposed, said support means including an input endplate for affixing said uniform tube outer conductor at the non-tapered input region to said linearly tapered inner conductor, and an output endplate for affixing said uniform tube outer conductor at the non-tapered output region to said linearly tapered inner conductor;

a plurality of input ports symmetrically disposed about the periphery of said uniform tube outer conductor in the non-tapered input region, said plurality of input ports including a corresponding plurality of input probes contoured to facilitate inpedance matching thereat;

a plurality of output ports symmetrically disposed about the periphery of said uniform tube outer conductor in the non-tapered output region, said plurality of output ports including a corresponding plurality of output probes contoured to facilitate impedance matching thereat;

input tuning means operatively connected to said uniform tube outer conductor and said linearly tapered inner conductor for tuning for an optimum impedance in the input port plane at said plurality of input ports, said input tuning means including an input annular shorting ring slidably and contiguously disposed between said uniform tube outer conductor and said linearly tapered inner conductor in the non-tapered input region for shorting out a portion of said coaxial waveguide commutator at its input, a movable input mounting plate, a plurality of connecting rods operatively connecting said input annular shorting ring to said movable input mounting plate, an input tuning adjustment screw threadedly journaled into said movable input mounting plate and said input endplate, and an input tuning knob fixedly connected to said input tuning adjustment screw and fixedly and rotatably attached to said movable input mounting plate; and output tuning means operatively connected to said uniform tube outer conductor and said linearly tapered inner conductor for tuning for an optimum impedance in the output port plane at said plurality of output ports, said output tuning means including an output annular shorting ring slidably and contiguously disposed between said uniform tube outer conductor and said linearly tapered inner conductor in the non-tapered output region for shorting out a portion of said coaxial waveguide commutator at its output, a movable output mounting plate, a plurality of connecting rods operatively connecting said output annular shorting ring to said movable output mounting plate, an output tuning adjustment screw threadedly journaled into said movable output mounting plate and said output endplate, and an output tuning knob fixedly connected to said output tuning adjustment screw and fixedly and rotatably attached to said movable output mounting plate.

* * * * *